United States Patent [19]

Wahlstrom

[11] 4,060,941

[45] Dec. 6, 1977

[54] HONE FOR ROTARY ELECTRIC RAZOR CUTTERS

[76] Inventor: Arvid S. Wahlstrom, Rte. 4, Grafton, N.H. 03240

[21] Appl. No.: 694,701

[22] Filed: June 10, 1976

[51] Int. Cl.[2] ..... B24D 15/04; B24D 15/10

[52] U.S. Cl. ..... 51/211 H; 76/DIG. 9; 30/90

[58] Field of Search ..... 30/30, 90; 51/211 R, 51/211 H, 285, 358, 394, 405, 407; 76/DIG. 9

[56] References Cited

U.S. PATENT DOCUMENTS

| | | | |
|---|---|---|---|
| 926,524 | 6/1909 | Wattles | 51/358 |
| 2,953,851 | 9/1960 | Wheeler | 51/285 X |
| 3,082,582 | 3/1963 | Jeske | 51/407 X |
| 3,229,425 | 1/1966 | Homeyer | 51/211 R |

FOREIGN PATENT DOCUMENTS

| | | | |
|---|---|---|---|
| 909,027 | 10/1962 | United Kingdom | 30/35 |

*Primary Examiner*—Gary L. Smith
*Attorney, Agent, or Firm*—Kenway & Jenney

[57] ABSTRACT

A manual hone for the plural cutting surfaces of a rotary electric razor cutter. A flat stone of rounded peripheral contour is mounted in an encircling plastic retainer. The retainer provides shock absorption and prevention of inadvertent passage of any cutting surface over an edge of the stone. A cushion or cushions may be provided within the retainer for absorbing excess finger pressure and additional shock absorption.

6 Claims, 3 Drawing Figures

HONE FOR ROTARY ELECTRIC RAZOR CUTTERS

BRIEF SUMMARY OF THE INVENTION

This invention relates generally to hones for fine cutting instruments, and more particularly to hones for sharpening the plural cutting surfaces of rotary electric razor cutters. Such a cutter generally cooperates with a nonrotating slotted skin-contacting member or head through which hairs may penetrate. The rotary cutting element has plural cutting surfaces for severing the penetrating hairs by shearing them against the sides of the slots.

When the cutting surfaces in such a razor become dull through use, they may be sharpened, but conventional sharpening means are either unreliable or so expensive as to be economically unattractive in view of the cost of replacement cutting elements. There is believed to be a need for a simple and inexpensive hone for sharpening such cutting elements, provided that reliable and effective results may be obtained with a minimum level of proficiency and practice.

The small areas of the plural cutting surfaces and the necessity for maintaining them in strictly parallel relationship present particular problems. The surface of the stone must obviously be perfectly flat, but in addition the pressure of each of the small cutting surfaces upon the stone must be maintained substantially the same during honing. Further, great care must be exercised to prevent any cutting surface from passing over any edge of the stone, as this is almost certain to break an edge of the cutting surface. If this is a cutting edge, the cutting element as a whole may be rendered useless.

Other objects to be attained for a practical and inexpensive hone are to provide a simple structure having adequate protection from inadvertent damage, as by dropping upon the floor, and means for readily cleaning the hone to remove metal particles and greasy substances or dirt from the honing surfaces.

With the foregoing and other objects in view, as further noted below, this invention comprises a hone having a stone of uniform thickness with flat parallel top and bottom surfaces, the surfaces having rounded outlines joined by a peripheral side, and a retainer for the stone formed of a resilient cushioning material and having a first portion closely fitting the entire peripheral side and extending substantially beyond the outlines in directions perpendicular to said surfaces, and a second portion integral with the first portion and extending in a plane normal thereto. These and other features will be understood by reference to the following description and the appended drawings.

DETAILED DESCRIPTION

Figure 1:
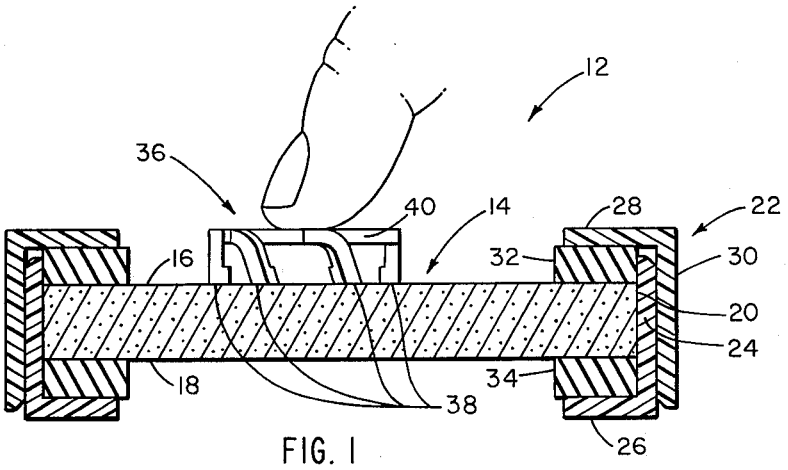
FIG. 1 is an elevation in section of a first embodiment of the invention.

FIG. 1 shows a manual hone 12 which is a preferred embodiment for maximum protection of the hone and accessibility of the stone for cleaning, although the other described embodiments also have advantages in these respects as well as even greater economy of manufacture.

A fine stone 14 has flat parallel top and bottom surfaces 16 and 18, respectively, the surfaces having rounded outlines joined by a peripheral side 20. The outlines of the top and bottom surfaces are preferably but not necessarily circular. The stone is monolithic and may be of uniform composition or may be laminated of two portions having different degrees of fineness.

A retainer 22 comprises inner and outer parts, the inner part having a first portion 24 and a second portion 26. The outer part comprises a third portion 28 and a fourth portion 30. These two parts are preferably formed of the same resilient cushioning material such as a molded plastic. The first and second portions of the inner part are preferably integrally molded, as are the third and fourth portions of the outer part. The first portion closely fits the entire peripheral side 20 and extends substantially beyond the outlines of the top and bottom surfaces in directions perpendicular to said surfaces. The second and third portions 26 and 28 have circular openings through them for access to the honing surfaces of the stone. The fourth portion 30 fits slidingly over the first portion 24.

A pair of resilient washer-like elements 32 and 34 of rubber or other suitable material fit against opposing marginal portions of each of the top and bottom surfaces of the stone, and are respectively retained by the portions 28 and 26 of the retainer. The firm frictional engagement of the portions 24 and 30 of the retainer holds the assembly together without the need for adhesives or fastening devices.

FIG. 1 shows a cutting element 36 in position for sharpening its plural small cutting surfaces 38. The element 36 is an integral metal body having a plurality of legs extending downwardly from a hub portion 40. Preferably, the hub portion has means (not shown) for engagement with a rotating spindle or shaft in an electric razor, for purposes of turning the cutting element. The legs are uniformly annularly spaced about the hub and are of identical shape, each leg projecting downwardly at an acute angle with respect to a perpendicular to the plane of the hub portion. Each of the cutting surfaces is of substantially square or rectangular shape, and the cutting surfaces are all ground to be coplanar.

In use of the hone, the cutting element 36 is placed upon the surface 16 of the stone, and pressed against the surface by a finger as illustrated. Alternatively, the element 36 may be similarly placed upon the surface 18. With light finger pressure applied, the element 36 is caused to describe circular or oblong paths over the surface 16 or 18. Since these paths are not defined by the hone structure but by the person using it, it is possible that the element 36 may strike one of the elements 32 or 34, but the cutting surfaces 38 will not be damaged as they would be if allowed to pass over the peripheral edges of the stone.

In the embodiment of FIG. 1 and each of the other illustrated embodiments, with the hone either held in the hand or preferably placed upon any convenient flat surface, pressure equalization between each of the cutting surfaces 38 and the surface 16 is aided by the resilient properties of the retainer. In the case of FIG. 1, the elements 34 and 32 are sufficiently resilient to cause the stone to deflect downwardly on any side thereof toward which excessive pressure is applied by the finger through the element 36. This relief of pressure on such side ensures that the cutting surfaces of the element 36 toward that side will not bear with excessive pressure upon the stone.

Figure 2:
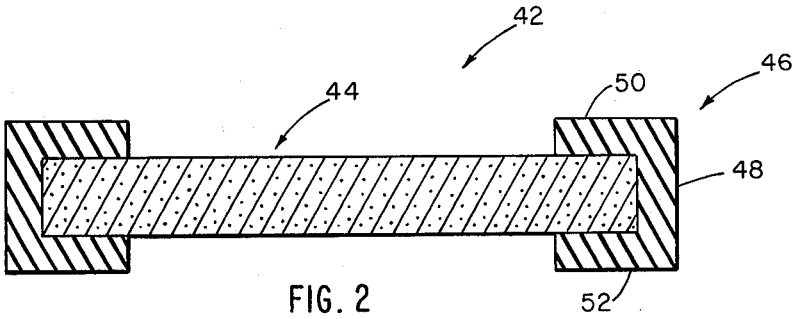
FIG. 2 is an elevation in section of a second embodiment of the invention.

FIG. 2 illustrates a second embodiment 42 simply comprising a stone 44 similar in all respects to the stone 14 of FIG. 1, and a one-piece retainer 46. The retainer 46 is preferably formed of an elastic material such as rubber, which may be stretched around the stone to conform closely to it and provide shock resistance as well as prevention of inadvertent damage to the cutting surfaces 38. Portions 48, 50 and 52 protect the peripheral side of the stone and marginal portions of its top and bottom surfaces.

In the embodiments of FIGS. 1 and 2, the retainer is of uniform cross section and is symmetrical when viewed in plan. Both of the top and bottom surfaces of the stone are exposed and accessible for cleaning and for use in honing, although one or the other of the sides of the stone may be enclosed, if desired.

Figure 3:
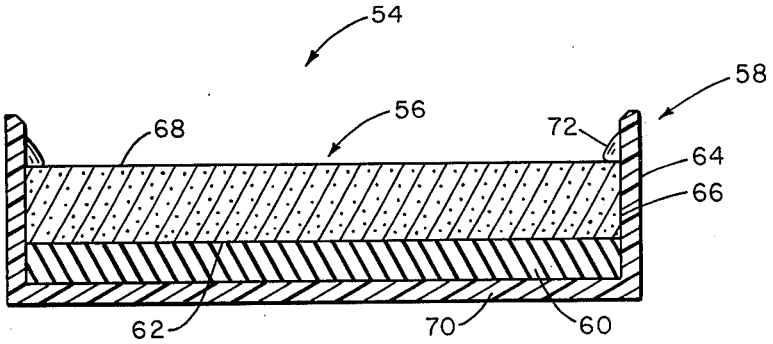
FIG. 3 is an elevation in section of a third embodiment of the invention.

FIG. 3 shows a third embodiment 54 comprising a stone 56 similar in all respects to the stone 14, a retainer 58 and a cushioning element 60 closely fitting the retainer and supporting the entire bottom surface 62 of the stone. The retainer is preferably a unitary plastic body with a first portion 64 closely fitting the entire peripheral side 66 of the stone and extending substantially beyond the outlines of the top surface 68 and the bottom surface 62 in directions perpendicular to said surfaces. A second portion 70 is integral with the portion 64 and extends in a plane normal thereto.

The portion 64 has a plurality of integral inwardly projecting portions 72, these portions being spaced from the portion 70 and mutually annularly spaced about the retainer. The portion 64 has sufficient resiliency to permit outward deflection of the portions 72 when the stone is pushed into a position firmly held between the element 60 and the portions 72.

As illustrated, the inwardly projecting portions 72 are in the general form of detent buttons of a convenient shape with upwardly directed surfaces of generally sloping contour to facilitate snapping the stone into the assembled position as illustrated.

If desired, the embodiment of FIG. 2 may be combined with one or the other of the embodiments of FIGS. 1 and 3. In this case, the assembled stone 44 and retainer 46 have dimensions permitting them to be inserted within retainers of the forms illustrated in FIG. 1 or FIG. 3. In this manner, it is possible to dispense with the separate washer-like elements 32 and 34 of FIG. 1 or the resilient member 60 of FIG. 3.

Other variations in uses and in the configurations of the parts and their mutual arrangements may also be accomplished consistently with the teachings of this invention, as will become apparent from the above description. For example, various objects other than razor cutters, such as metallurgical specimens, may be ground or polished with the described hones.

I claim:

1. A manual hone for a rotary electric razor cutter with plural coplanar cutting surfaces, said hone comprising, in combination, a stone of uniform thickness having flat parallel top and bottom surfaces, the surfaces having rounded outlines joined by a peripheral side, and a retainer for the stone formed of a resilient cushioning material and comprising separate inner and outer parts, the inner part having a first portion closely fitting the entire peripheral side and extending substantially beyond said outlines in directions perpendicular to said surfaces and a second portion integral with the first portion and extending in a plane normal thereto, the outer part having a third portion extending in a plane normal to the first portion and a fourth portion integral with the third portion, extending in a plane normal thereto and slidingly fitting over said first portion, the stone being supported fittingly between said second and third portions.

2. A manual hone according to claim 1 with a resilient washer-like element between a marginal portion of one of said surfaces and one of said second and third portions.

3. A manual hone according to claim 1, with a resilient washer-like element fitting against a marginal portion of each said surface and retained by one of said second and third portions.

4. A manual hone for a rotary electric razor cutter with plural coplanar cutting surfaces, said hone comprising, in combination, a stone of uniform thickness having flat parallel top and bottom surfaces, the surfaces having rounded outlines joined by a peripheral side, and a retainer for the stone formed of a resilient cushioning material and having a first portion closely fitting the entire peripheral side and extending substantially beyond said outlines in directions perpendicular to said surfaces, a second portion integral with the first portion and extending in a plane normal thereto, and an inwardly projecting portion spaced from the second portion, the stone being firmly held in a position between said second and inwardly projecting portions, the first portion having sufficient resiliency to permit outward deflection of the inwardly projecting portion when the stone is pushed into said position.

5. A manual hone according to claim 4, including a resilient element fitting between the stone and said second portion.

6. A manual hone according to claim 4, including a plurality of annularly spaced inwardly projecting portions integral with said first portion.

* * * * *